US008531308B2

(12) United States Patent
Dickie et al.

(10) Patent No.: US 8,531,308 B2
(45) Date of Patent: Sep. 10, 2013

(54) METHODS AND SYSTEMS FOR DISPLAYING A MESSAGE IN A WIDE-SPECTRUM DISPLAY

(75) Inventors: Connor Dickie, London (CA); Jeffrey Shell, Toronto (CA)

(73) Assignee: Kameraflage, Inc., Toronto, Ontario (CA)

( * ) Notice: Subject to any disclaimer, the term of this patent is extended or adjusted under 35 U.S.C. 154(b) by 331 days.

(21) Appl. No.: 12/863,959

(22) PCT Filed: Jul. 3, 2008

(86) PCT No.: PCT/US2008/069208

§ 371 (c)(1), (2), (4) Date: Jul. 21, 2010

(87) PCT Pub. No.: WO2009/094043

PCT Pub. Date: Jul. 30, 2009

(65) Prior Publication Data

US 2010/0289665 A1 Nov. 18, 2010

Related U.S. Application Data

(60) Provisional application No. 61/022,380, filed on Jan. 21, 2008, provisional application No. 61/031,782, filed on Feb. 27, 2008.

(51) Int. Cl.
*G08B 5/00* (2006.01)
*G09G 5/00* (2006.01)

(52) U.S. Cl.
USPC ..... 340/815.4; 340/461; 340/972; 362/124; 345/4; 345/7; 345/9; 345/473

(58) Field of Classification Search
USPC ..... 340/815.4
See application file for complete search history.

(56) References Cited

U.S. PATENT DOCUMENTS

| | | | | |
|---|---|---|---|---|
| 2,015,170 | A * | 9/1935 | Ward | 40/543 |
| 4,602,191 | A * | 7/1986 | Davila | 315/76 |
| 4,703,573 | A * | 11/1987 | Montgomery et al. | 40/455 |
| 5,633,623 | A * | 5/1997 | Campman | 340/321 |
| 6,809,792 | B1 * | 10/2004 | Tehranchi et al. | 352/85 |

* cited by examiner

*Primary Examiner* — Donnie Crosland
(74) *Attorney, Agent, or Firm* — Choate Hall & Stewart LLP; Brenda Herschbach Jarrell; William R. Haulbrook

(57) ABSTRACT

The disclosed technology, in certain embodiments, includes a method and system for displaying messages in a wide-spectrum display includes a visible element comprising a first portion of a message and an invisible element comprising a second portion of the message. In one aspect, the method includes the step of displaying, in the visible element, e.g. an image from a film, a captured photograph or a first part of an advertisement. In certain embodiments, content may be displayed in the invisible element including, for example, subtitles, metadata or a second part of an advertisement. An individual may choose to view the invisible element by viewing the wide spectrum display through a wavelength conversion device. Also disclosed are the use of the display in games, and of its integration in wearable material.

20 Claims, 12 Drawing Sheets

METHODS AND SYSTEMS FOR DISPLAYING A MESSAGE IN A WIDE-SPECTRUM DISPLAY

RELATED APPLICATIONS

This application is a national phase application under 35 U.S.C. §371 of International Application No. PCT/US08/69208, filed Jul. 3, 2008. PCT/US08/69208 claims priority to U.S. Application No. 61/031,782, filed Feb. 27, 2008, and U.S. Application No. 61/022,380, filed Jan. 21, 2008, the contents of which are hereby incorporated by reference in their entirety.

FIELD OF THE INVENTION

The present disclosure relates to methods and systems for displaying messages. In particular, the present disclosure relates to methods and systems for displaying messages in a wide-spectrum display.

BACKGROUND OF THE INVENTION

Most human eyes can "see" wavelengths ranging from 380 nm-750 nm on the electromagnetic spectrum (hereafter referred to as the "visible spectrum"). Wavelengths beyond this range are imperceptible to the human eye (hereafter referred to as the "invisible spectrum"). However, wavelengths in the invisible spectrum can be perceived by humans if viewed through a wavelength conversion device. The Charge Coupled-Device (CCD) or Complementary Metal-Oxide-Semiconductor (CMOS) chip used in many digital cameras is an example of such a conversion device. When a scene is viewed through such cameras, the CCD or CMOS chip converts certain wavelengths in the invisible spectrum into the visible spectrum.

Systems using wavelength conversion devices typically focus on allowing a user to view either an image in the visible spectrum or an image in the invisible spectrum, but not both. Those systems that do allow a user to view images in both the visible and invisible spectrum are typically providing a preventative measure against a perceived threat—focusing, for example, on copyright management and on obscuring a visible spectrum image with an image in the invisible spectrum. Conventional systems do not enhance the visible images, and typically use the invisible images to replace, destroy or prevent others from viewing the visible images.

BRIEF SUMMARY OF THE INVENTION

The present disclosure relates to synthesizing displays of content invisible to the human eye with a visible scene, producing a wide-spectrum information display. In one aspect, a wide-spectrum display includes a visible element and an invisible element. The visible element includes a first portion of a message. The invisible element includes a second portion of the message.

In one embodiment, the visible element includes an image in filmed content. In another embodiment, the visible element includes an image in live content. In still another embodiment, the visible element includes an image in an advertisement. In yet another embodiment, the visible element includes an image in a game.

In one embodiment, the invisible element includes metadata associated with the first portion of the message. In another embodiment, the invisible element includes a tag associated with the first portion of the message. In still another embodiment, the invisible element includes invisible content forming, in combination with the visible element an advertisement. In still even another embodiment, the invisible element includes invisible content forming, in combination with the visible element, a portion of a game. In yet another embodiment, the invisible element includes content visible through a wavelength conversion device. In some embodiments, the invisible element includes content displayed in the invisible spectrum enhancing the first portion of the message in the visible element. In some embodiments, the invisible element includes content displayed in the invisible spectrum unrelated to the first portion of the message in the visible element.

In another aspect, a method for displaying a message in a wide-spectrum display includes the step of displaying, in a visible element, a first portion of a message. The method includes the step of displaying, in an invisible element, a second portion of the message. In one embodiment, the method includes the step of projecting the visible element onto a surface. In another embodiment, the method includes the step of producing, by an invisible spectrum light emitter, the invisible element. In still another embodiment, the method includes the step of displaying, in the invisible element, invisible content displaying, in combination with the visible element, an enhanced message.

BRIEF DESCRIPTION OF THE DRAWINGS

The foregoing and other objects, aspects, features, and advantages of the disclosure will become more apparent and better understood by referring to the following description taken in conjunction with the accompanying drawings, in which.

DETAILED DESCRIPTION OF THE INVENTION

Figure 1:
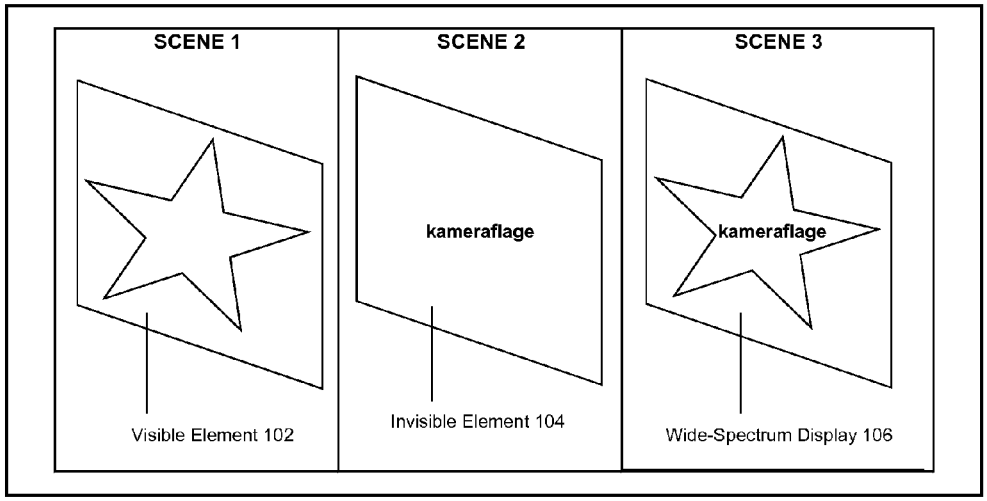
FIG. 1 is a block diagram depicting one embodiment of a system for displaying a message in a wide-spectrum display.

Referring now to FIG. 1, a block diagram depicts one embodiment of a system for displaying a message in a wide-spectrum display. In brief overview, the system includes a visible element 102 comprising a first portion of a message and an invisible element 104 comprising a second portion of the message. Viewed together, the visible element 102 and the invisible element 104 form a wide-spectrum display 106.

Referring now to FIG. 1, and in greater detail, a visible element 102 comprises a first portion of a message. In one embodiment, the visible element 102 is displayed in the visible spectrum that most people are able to perceive naturally. In another embodiment, the visible element 102 displays an image within filmed content. In still another embodiment, the visible element 102 displays an image within live content. In still even another embodiment, the visible element 102 displays an image within an advertisement. In yet another embodiment, the visible element 102 displays an image within a game. In some embodiments, the visible element 102 displays static content. In other embodiment, the visible element 102 displays dynamic content.

In one embodiment, the visible element 102 is a billboard. In another embodiment, the visible element 102 is an indoor retail display. In still another embodiment, the visible element 102 is a corrugated retail display. In still another embodiment, the visible element 102 is packaging. In yet another embodiment, the visible element 102 is corrugated packaging.

In one embodiment, the visible element 102 is a poster. In another embodiment, the visible element 102 is a toy. In yet another embodiment, the visible element 102 is a consumer packaged good.

In one embodiment, the visible element 102 is shown in a television. In another embodiment, the visible element 102 is shown in a movie screen. In still another embodiment, the visible element 102 is shown in a computer monitor. In yet another embodiment, the visible element 102 an image frame captured by an imaging device. In some embodiments, the visible element 102 is shown in a back-lit light box. In other embodiments, the visible element 102 is shown in an edge lit light box. In still other embodiments, the visible element 102 is shown within a light box that is both edge lit and back lit.

An invisible element 104 comprises a second portion of the message. In one embodiment, the invisible element 104 is displayed in the invisible spectrum. In another embodiment, the invisible element 104 displays content visible via a wavelength conversion device. In still another embodiment, the invisible element 104 displays content displayed in the invisible spectrum enhancing the first portion of the message displayed by the visible element 102.

In one embodiment, the invisible element 104 displays content in the invisible spectrum that contributes to or completes a scene for artistic, advertising, public information and announcement display purposes that becomes visible when viewed through a wavelength conversion device. In another embodiment, this form of message production does not obstruct images visible to the human eye when the wavelength conversation device is not applied. Thus, individuals choose whether to examine the wide-spectrum display 106 through a wavelength conversion device or to view the visible element 102 and remain impervious to the invisible message in the wide-spectrum display.

In one embodiment, the invisible element 104 displays metadata associated with the first portion of the message in the visible element 102. In another embodiment, these metadata can provide context including, but not limited to the time, location or event where the wide-spectrum display is viewed. This can be captured in a photograph and used to interpret either the visible image 102 or the wide-spectrum image 106 after it is captured. In another embodiment, the invisible element 104 displays content in the invisible spectrum from the back, front, side (edge) or the surface itself of a material or surface that contributes to or completes a scene when rendered visible through a wavelength conversion device. In some embodiments, the invisible element 104 displays static content. In other embodiment, the invisible element 104 displays dynamic content. In one embodiment, the static content in the invisible element 104 is a fixed image of a clock. In another embodiment, the dynamic content in the invisible element 104 is a clock that always displays the accurate time; as time passes, the image that is displayed in the invisible spectrum 104 changes to reflect the current time. In some embodiments, the invisible dynamic content includes graphics, text, or animations that relate to or contribute to a static or dynamic visual scene. In other embodiments where both invisible content 104 and visible content 102 are dynamic, the visible and invisible image sequences are synchronized.

In one embodiment, the invisible element 104 displays a tag associated with the first portion of the message in the visible element 102. In another embodiment, the invisible element displays tags that provide information identifying objects photographed using CCD or CMOS based digital cameras, many of which are implicitly wavelength conversion devices. For example, and in some embodiments, a visible element may include a physical object and the invisible element may display a tag identifying the object when the object is photographed using a CCD or CMOS-based digital camera. In another embodiment, the invisible tag may include information that describes or situates the visible element. In some embodiments, invisible tag describes the historical significance of the artifact displayed in the visible element.

In one embodiment, the invisible element 104 displays invisible content forming, in combination with the visible element, a portion of a game. In another embodiment, the invisible element 104 includes content in the invisible spectrum for Alternate Reality Gaming (ARG) applications, other 'treasure hunts', promotional events, and search tasks, that contributes to or completes a scene when rendered visible through a wavelength conversion device. In still another embodiment, the wide-spectrum display 106 allows providers the opportunity to hide "clues" in an environment that are only accessible when viewing invisible content. In still even another embodiment, content providers can hide riddles, quests, and quizzes in the environment that are displayed in the invisible spectrum. In yet another embodiment, these challenges may reference or relate to external media, media spaces, and other real or virtual interaction spaces.

In one embodiment, the invisible element 104 displays a subtitle to the portion of the message displayed by the visible element 102. In one embodiment, because the subtitles are invisible, they enhance the visible content for those users who choose to view the invisible content while not distracting individuals who choose to ignore the invisible content. In another embodiment, this wide-spectrum information display improves accessibility of visible content to groups including, but not limited to, the hearing-impaired or other individuals with special needs and individuals who require or prefer language translations.

In one embodiment, the invisible element 104 displays invisible content forming, in combination with the visible element, an advertisement. In another embodiment, the invisible element 104 displays content in the invisible spectrum that contributes to or completes a scene for advertising, advocacy and brand promotion activities that becomes visible when viewed through a wavelength conversion device. In still another embodiment, the wide-spectrum display 106 provides an alternative method by which information relating to products, offers, positions, concepts and events can be promoted.

Viewed together, the visible element 102 and the invisible element 104 form a wide-spectrum display 106. In one embodiment, when viewed by a user of a wavelength conversion device, the user sees "Scene 3", a synthesis of "Scene 1" in the visible element 102 and "Scene 2" in the invisible element 104. In another embodiment, the invisible element is displayed upon materials including, but not limited to, advertising boxes, light boxes, retail displays, cinema screens, billboards, packaging, toys, clothing, apparel, consumer packaged goods and other objects, that contain or project static or dynamic content in the visible spectrum, while the invisible element contributes to or completes a scene when rendered through a wavelength conversion device. In still another embodiment, the invisible element 104 displays content in the invisible spectrum that identifies the visible scene, providing information including, but not limited to, copyright information, Uniform Resource Identifiers (URIs), web address(es), product label(s), email address(es), text message number(s), text message short code(s), or other identifying meta data or tags that become visible to a human when rendered visible through a wavelength conversion device. In another embodiment, the invisible content displayed by the invisible element 104 provides context for interpreting the visible image without interfering with the visible scene.

In one embodiment, the visible element 102 and the invisible element 104 viewed together form a scene in a physical environment. In another embodiment, the visible element 102 includes, but is not limited to trees, statues, buses, automobiles, trains, benches, bus shelters, street furniture, doors, walls, smooth surfaces, rounded surfaces and surfaces with texture. In still another embodiment, a signifier such as, but not limited to, a glyph, symbol or text, indicates the presence of an invisible element 104 (and, therefore, of a wide-spectrum display 106). In still even another embodiment, the visible element 102 is a physical object in an environment that, in conjunction with a signifier indicating the presence of an invisible element 104 and the invisible element 104 itself, form a wide-spectrum display. In yet another embodiment, regions of the visible spectrum backlight brightly flash to mimic the flash of a camera, indicating the presence of an invisible element 104 (and, therefore, of a wide-spectrum display 106). In some embodiments, the visible element 102 and the invisible element 104 are related to each other. In one of these embodiments, for example, the visible element 102 may be a physical object such as a building and the invisible element 104 may be information about the building (an identifying tag or metadata, for example). In other embodiments, the visible scene and invisible element 104 are not related to each other. In one of these embodiments, for example, the visible element 102 may be a physical object such as a building or a component in a game and the invisible element 104 may display unrelated data such as an advertisement.

In one embodiment, a wide-spectrum display refers to a display of an invisible element in combination with the display of a visible element. In another embodiment, a wide-spectrum display refers to the display of an invisible element in combination with a visible element. In another embodiment, a wide-spectrum display refers to the display of an invisible element in combination with a visible scene. In still another embodiment, a wide-spectrum display refers to a display of an invisible element projected onto a physical visible element. In still another embodiment, a wide-spectrum display refers to a display of an invisible element projected onto a visible element which is itself a projected image. In still even another embodiment, a wide-spectrum display refers to an invisible element displayed with a visible element, the invisible element and the visible element both displayed by a single apparatus (for example, an apparatus including a first surface displaying the visible element and an invisible-spectrum light source displaying the invisible element onto at least one of the first surface and a second surface). In yet another embodiment, a plurality of components is used to render the invisible element and the visible element. In some embodiments, a wide-spectrum display refers to both i) the apparatus that renders the invisible element and the visible element and to ii) the invisible element and the visible element rendered visible by a user of a wavelength conversion device viewing the invisible element and the visible element.

In some embodiments, the wide-spectrum display 106 allows for the production of content on various objects in the environment, such as heritage buildings where physically changing its appearance in the visible spectrum is not desirable or permitted. In other embodiments, the wide-spectrum display is a scene in the environment. In one of these embodiments, the visible element 102 is a physical object within the scene. In still other embodiments, the display is a scene framed by an imaging device including, but not limited to a digital camera, a camera, a movie camera, a video camera and a film camera. In yet other embodiments, the display is a scene framed by a viewing enhancement device, including but not limited to binoculars, night vision goggles, 3d glasses, and other vision augmenting eyewear.

In some embodiments, the invisible element 104 displays encoded content in the invisible spectrum that, when rendered visible through a wavelength conversion device and then decoded, identifies or relates to the visible scene. In one of these embodiments, the decoded content includes a reference to an external source of information. In another of these embodiments, the decoded content contains content that complements, contributes or relates to the visible scene. In still another of these embodiments, the decoded content includes, without limitation, copyright information, Uniform Resource Identifiers (URIs), web address(es), email address(es), product label(s), text message number(s), text message short code(s), signature(s), key(s), or other identifying tags. In still even another of these embodiments, the encoding scheme may employ Bar Codes, Universal Product Codes (UPCs), a two dimensional matrix bar code (such as data matrix codes, QR codes, and SEMACODES) or other graphical or symbolic encoding schemes. In still another embodiment, the encoding scheme may employ Pulse Code Modulation (PCM), or another method that encodes a message using the frequency of transmitted light. In yet another of these embodiments, the wavelength conversion device, or other associated technology triggers an action responsive to decoding the encoded content; for example, the device may send a text message to the short code, send an email to the specified address, or direct a browser to the specified email address.

In some embodiments, a user of the system views the wide-spectrum display 206 through a client device including a wavelength conversion device. In one embodiment, the client can be any computer, mobile telephone or other portable telecommunication device, media playing device, mobile computing device, or any other type and/or form of computing, telecommunications or media device that has sufficient processor power and memory capacity to perform the operations described herein. In another embodiment, the client is a TREO 180, 270, 600, 650, 680, 700p, 700w, or 750 smart phone manufactured by Palm, Inc. In still another embodiment, the client is a mobile device, such as a JAVAenabled cellular telephone or personal digital assistant (PDA), such as the i55sr, i58sr, i85s, i88s, i90c, i95cl, or the im1100, all of which are manufactured by Motorola Corp. of Schaumburg, Ill., the 6035 or the 7135, manufactured by Kyocera of Kyoto, Japan, or the i300 or i330, manufactured by Samsung Electronics Co., Ltd., of Seoul, Korea. In still even another embodiment, the client is a mobile device manufactured by Nokia of Finland, or by Sony Ericsson Mobile Communications AB of Lund, Sweden. In still another embodiment, the client is a Blackberry handheld or smart phone, such as the devices manufactured by Research In Motion Limited, including the Blackberry 7100 series, 8700 series, 7700 series, 7200 series, the Blackberry 7520, or the Blackberry Pearl 8100. In yet another embodiment, the client is a smart phone, Pocket PC, Pocket PC Phone, or other handheld mobile device supporting Microsoft Windows Mobile Software. In other embodiments, the client comprises a combination of devices, such as a mobile phone combined with a digital audio player or portable media player. In one of these embodiments, the client is a Motorola RAZR or Motorola ROKR line of combination digital audio players and mobile phones. In another of these embodiments, the client is an iPhone smartphone, manufactured by Apple Computer of Cupertino, Calif. Other wavelength conversion devices include night vision apparatuses, including night vision goggles, night vision binoculars and night vision cameras. Still other wavelength conversion processes include photographic techniques, filters and apparatus that are applied in infrared, or ultra violet photography.

In some embodiments, a wide-spectrum display comprises a visible element 102 displaying a first message and an invisible element 104 coupled to the visible element and displaying a second message. In one of these embodiments, the visible element and the invisible element are visible elements 102 and invisible elements 104 as described above; however, the elements need not display related messages or portions of a single message. In another of these embodiments, the visible element 102 may each display an image, a projected image, at least a portion of a filmed work, at least a portion of a game, a second advertisement or other content as described above, and the invisible element 104 may display a second image, at least a portion of a second filmed work, at least a portion of a second game, a second advertisement, or other content. In still another of these embodiments, the visible element 102 is a physical object. In still even another of these embodiments, an invisible-spectrum light source coupled to the visible element 102 displays the invisible element 104. In yet another of these embodiments, and as discussed in greater detail below in connection with FIG. 4C, the wide-spectrum display includes an outer frame coupling the invisible element to the visible element.

Figure 2A:
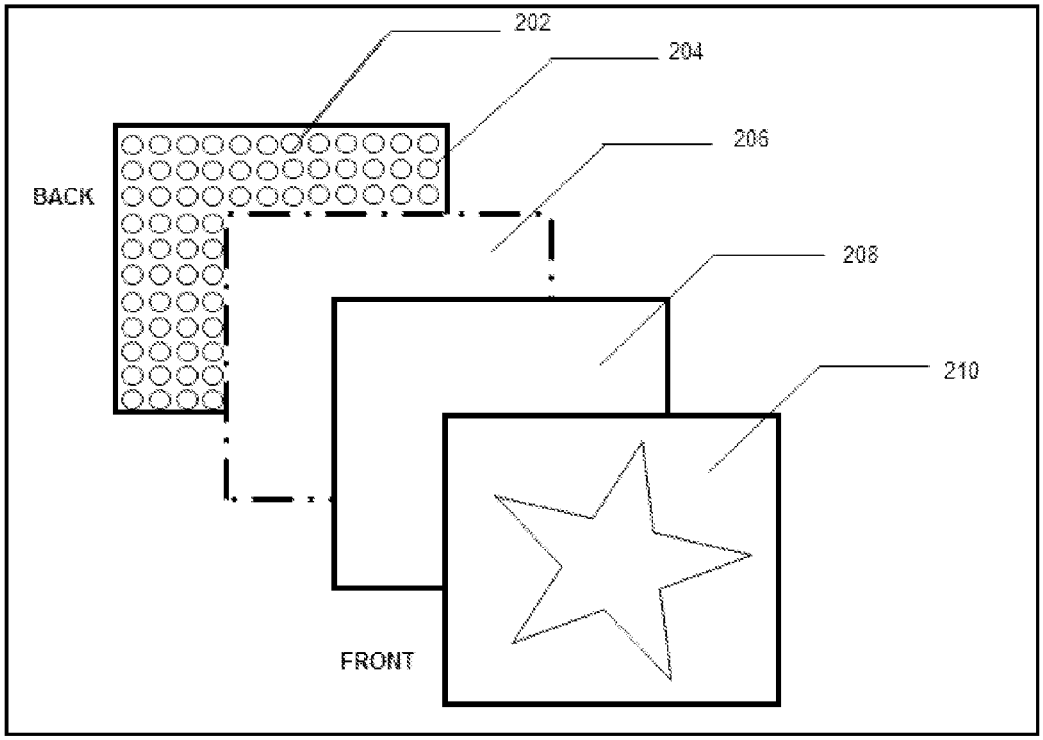
FIG. 2A is a block diagram depicting an embodiment of a system for displaying a message in a wide-spectrum display.

Referring now to FIG. 2A, a block diagram depicts an embodiment of a system for displaying a message in a wide-spectrum display. In brief overview, the system includes an invisible spectrum source 202, a back surface 204, and a front surface 210. In one embodiment, the system includes a light-diffusing layer 206. In another embodiment, the system includes a mask 208 allowing invisible light through selected areas to sharpen the invisible image.

Referring now to FIG. 2A, and in greater detail, in one embodiment, the invisible spectrum source 202 is produced by at least one of a Light-Emitting Diode (LEDs), an Organic Light-Emitting Diode (OLEDs), electroluminescent material, electroluminescent ink, quantum dots, fluorescent lighting, a Liquid Crystal Display (LCDs), a projector, Cold Cathode Florescent Lighting (CCFL), ink, Laser, a Digital Light Projector (DLPs), full-spectrum light passed through a selective wavelength modifier (filter, high pass filter, low pass filter, band pass filter, hot mirror, cold mirror, dichroic filter, dichroic mirror, dichroic reflector) to isolate specific spectra, or any other light-emitting apparatus or means of producing invisible light generally, and infrared or ultraviolet light specifically. In another embodiment, the invisible spectrum light is passed through a diffusing surface or series of surfaces to make the light more uniform, such as the light-diffusing layer 206. In still another embodiment, the invisible spectrum light is passed through a light-diffusing layer 206 that increases the image's viewing angle from the perspective of the audience. In yet another embodiment, the light is also passed through a mask 208 that sharpens and produces a more refined image in the invisible spectrum.

In some embodiments including both a light-diffusing layer 206 and a mask 208, the order of the light-diffusing layer 206 and the mask 208 is arbitrary. In other embodiments including both a light-diffusing layer 206 and a mask 208, diffusing before masking will produce a sharp image. In still other embodiments, a single layer or apparatus provides the functionality of both the light-diffusing layer 206 and the mask 208. In one of these embodiments, for example, an embodiment using a high resolution, evenly-illuminated emission apparatus, neither the light-diffusing layer 206 nor the mask 208 is required.

In one embodiment, the mask 208 is made from any material that is opaque in the invisible spectrum. In another embodiment, the mask 208 is made from a selective wavelength modifier (filter) such as a dichroic filter or a different light filter, or set of filters that allows visible light through to illuminate the display, while blocking certain wavelengths of invisible light produced by the invisible light emitter. In still other embodiments, the mask 208 serves as a high pass, low pass or band pass filter. In still another embodiment, the mask 208 shapes the invisible light into an image that, when viewed through a wavelength conversion device, complements and contributes to the visible image present on the front surface 210.

In some embodiments, the mask 208 is made from a substance that filters, reflects or attenuates transmission of specific bands in the electromagnetic spectrum. In other embodiments, the mask 208 is made from a substance including, but is not limited to films, coatings or laminates. In still other embodiments, the mask 208 is made from a metallic substance. In still even other embodiments, the mask 208 is made from a non-metallic substance. In yet other embodiments, the mask 208 is made using a spectrally selective substance composed of one or a combination of polyester, ceramic, silver, aluminum, plastic, polymer, or some other substance.

In some embodiments, the mask 208 is made from spectrally selective materials, including, but not limited to window films, security films, safety films, nano ceramic films, display enhancement films, privacy films, heat blocking films, heat mirror films, solar reflectance films, other films, coatings or laminates.

In one embodiment, the front surface 210 displays the invisible spectrum light, which complements and contributes to the visible image already present on the surface 210 when viewed through a wavelength conversion device. In another embodiment, the front surface 210 is comprised of a material such as, but not limited to, vinyl, acrylic, glass, plastic, paper, Dacron, cotton, polyester, satin, taffeta, and film. In still another embodiment, the front surface 210 is a surface treated with dyes, inks or other coloring agents that are fully or partially transparent in the invisible spectrum. In yet another embodiment, the back surface 204 and the front surface 210, with any optional layers, form a display appropriate for environments with controlled and consistent visible lighting such as, but not limited to, in-store retail, malls, public transit centers, clubs, bars, arenas, nightclubs and indoor sporting venues.

In some embodiments, a visible light source provides consistent illumination to a display in environments lacking controlled or consistent lighting. In one of these embodiments, the visible light source is placed in front of the front surface 210 and oriented towards the front surface 210. In another of these embodiments, the visible light source enhances predictability in variable lighting environments, including certain outdoor environments, providing illumination for displays such as outdoor billboards, bus shelter displays, and street furniture.

Figure 2B:
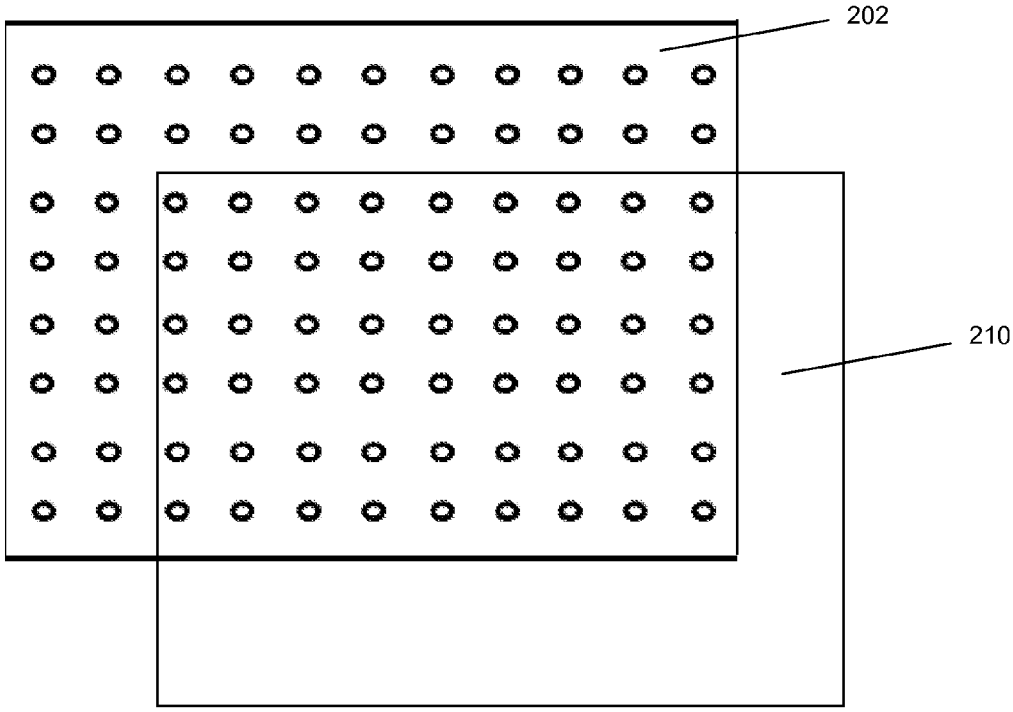
FIG. 2B is a block diagram depicting an embodiment of a light-emission apparatus including an invisible spectrum source.

Referring now to FIG. 2B, a block diagram depicts one embodiment of a light emission apparatus including an invisible spectrum source 202. In one embodiment, the invisible spectrum source 202 is a high-resolution, evenly-illuminated light emission apparatus. In another embodiment, the light emission apparatus includes an array of invisible spectrum emitters, where each array element (pixel) can be selectively turned on or off. In still another embodiment, the light emission apparatus includes an array of invisible spectrum emitters, where array element (pixel) groups can be selectively turned on or off. In still even another embodiment, the light emission apparatus includes an array of invisible spectrum emitters, where each array element (pixel) can be selectively driven with variable power, producing variations in output intensity forming a grayscale effect. In still another embodiment, the light emission apparatus includes an array of invisible spectrum emitters, where each array element (pixel) can be selectively driven with variable power, producing variable output intensity by altering the duty cycle of its input power source. In another embodiment, the light emission apparatus is an invisible spectrum source 202 as described above in connection with FIG. 2B but includes neither the light-diffusing layer 206 nor the mask 208. In yet another embodiment, the light emission apparatus includes a front layer 210 that is transparent and devoid of content in the visible spectrum.

In some embodiments, the light emission apparatus in combination with a physical object forms a wide-spectrum display 106. In one of these embodiments, the light emission apparatus displays an invisible element 104 and the physical object is the visible element 102. In another of these embodiments, and for example, the light emission apparatus is attached to a physical, visible element 102—such as a building, billboard, poster, structure, vehicle, or other physical object—and displays, via an invisible element 104, a message, which may or may not be related to a message displayed by the physical, visible element 102.

Figure 3A:
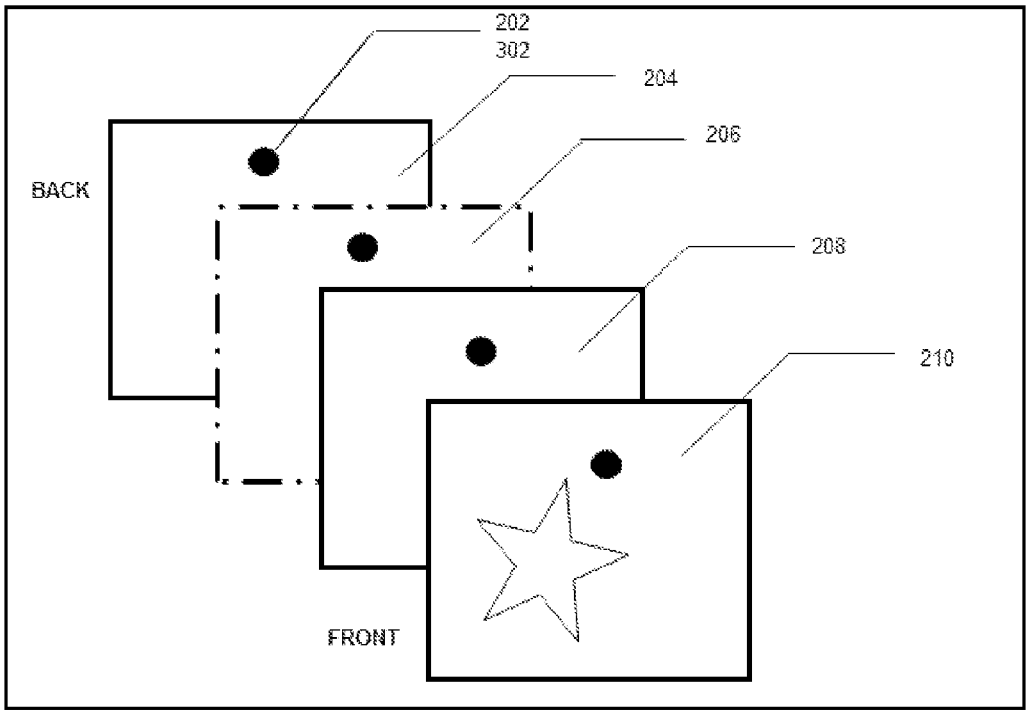
FIG. 3A is a block diagram depicting one embodiment of a wide-spectrum display including uniform visible spectrum illumination of an image surface.

Referring now to FIG. 3A, a block diagram depicts an embodiment of a wide-spectrum display including uniform visible spectrum illumination of an image surface. The system includes a combination of visible light 302 and invisible light 202. The system also includes a back surface 204, and a front surface 210. In some embodiments, the system contains light-diffusing layer(s) 206. In some embodiments, the system contains a mask 208 which allows invisible light through selected areas to sharpen the invisible image, while transmitting most or all visible light. In addition to producing light in the invisible spectrum from the back of the display, the system depicted in FIG. 3A also produces light in the visible spectrum from the back of the display, giving the box the appearance of a backlit advertising light box to an audience who chooses not to view the display through a wavelength conversion device.

Figure 3B:
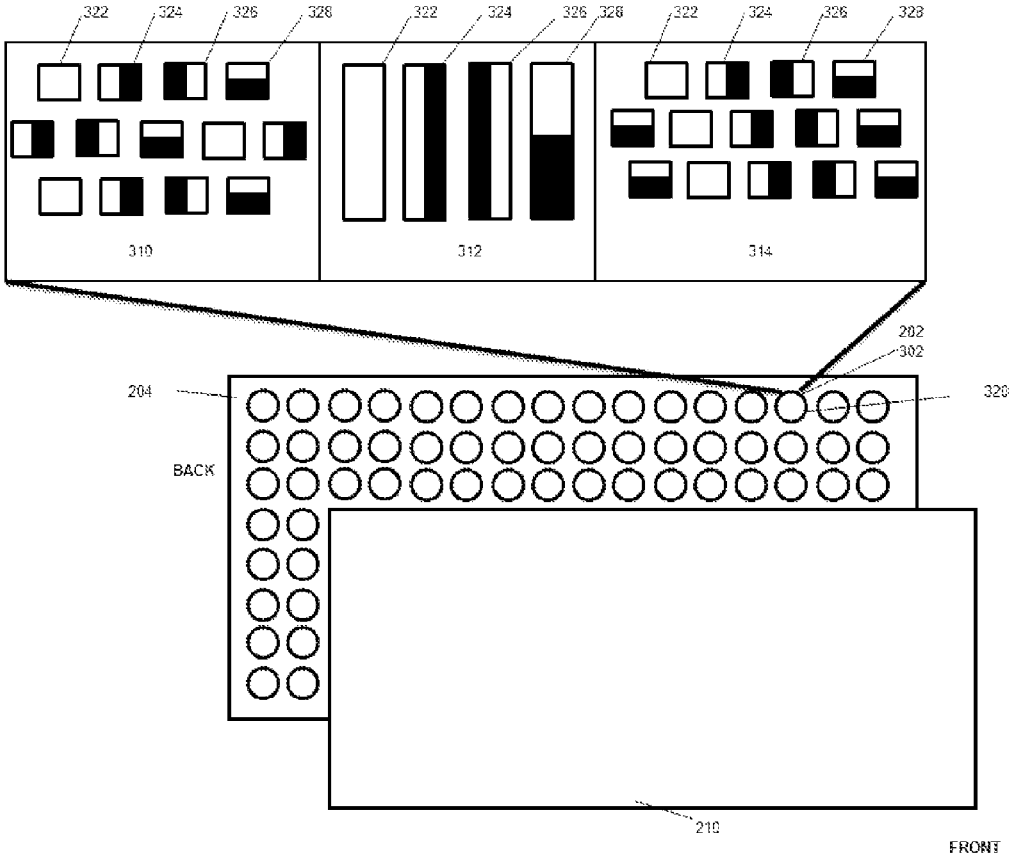
FIG. 3B is a block diagram depicting one embodiment of a wide-spectrum display originating from wide-spectrum pixels.

Referring now to FIG. 3B, a block diagram depicts another embodiment of a wide-spectrum display including uniform visible spectrum illumination of an image surface. The system includes a combination of visible light 302 and invisible light 202 both originating from a wide-spectrum picture element (pixel) 320. The system also includes a back surface 204, and a front surface 210. In some embodiments, an array of picture elements 320 produces high-resolution, wide-spectrum emissions from the back surface 204 of the display. In other embodiments, the array of wide-spectrum pixels produces full color visible light 302 that passes through the front surface 210 of the display. In still other embodiments, each pixel 320 is composed of subpixels which emit a narrow band of light; certain subpixels emit light in the visible spectrum 302 and certain subpixels emit light in the invisible spectrum 202. In still even other embodiments, the union of visible subpixels can reproduce colors in the visible spectrum, in addition to certain wavelengths in the invisible spectrum. In yet other embodiments, the union of visible subpixels can reproduce any color in the visible spectrum, in addition to certain wavelengths in the invisible spectrum.

In one embodiment, each pixel 320 contains four subpixels producing red 324, green 326, blue 328 and invisible light 322 respectively. In another embodiment, each subpixel has individual brightness controls. In still another embodiment, by adjusting individual brightness controls, the wide-spectrum pixel 320 can produce wavelengths of visible light 302 and certain wavelengths of invisible light 202. In still even another embodiment, the subpixels are organized in patterns throughout the display. In still another embodiment, the subpixels are offset vertically in a pattern throughout the display. In yet another embodiment, the subpixels are offset horizontally in a pattern throughout the display 314.

In one embodiment, the subpixels are oriented in a triangular pattern 310, shifting the placement of each subpixel horizontally for each successive line. In another embodiment, the subpixels are oriented in a pattern where each subpixel is only adjacent to subpixels representing different colors. In another embodiment, the subpixels are oriented in stripes 312 where each subpixel is longer in the vertical dimension than in the horizontal dimension. In still another embodiment, the subpixels are oriented in stripes where each subpixel is longer in the horizontal dimension than the vertical dimension. In yet another embodiment, the wide-spectrum display has the appearance of a television to an audience who chooses not to view the display through a wavelength conversion device, and a wide-spectrum display to those who do.

In connection with FIGS. 2A-2B and 3A-3B, and in some embodiments that employ a mask 208, the invisible image can be changed by replacing the mask with a new mask 208, defining a new invisible spectrum shape. In other embodiments that have the visible image on the front of the display 210, the visible image can be changed by replacing the front of the display with a substrate containing a new image. In still other embodiments where the mask 208 and the front of the display 210 are on the same layer, both the visible and invisible layer can be changed by replacing the front layer of the display.

In some embodiments, for example, embodiments employing a high resolution light emission apparatus, a high resolution invisible light emitting array, or a high resolution array of wide-spectrum emitting pixels, the displayed invisible image is contained in onboard computer memory. In other embodiments, the onboard computer has a memory apparatus. In one of these embodiments, the memory unit may be one or more memory chips capable of storing data and allowing any storage location to be directly accessed by a microprocessor, such as Static random access memory (SRAM), Burst SRAM or SynchBurst SRAM (BSRAM), Dynamic random access memory (DRAM), Fast Page Mode DRAM (FPM DRAM), Enhanced DRAM (EDRAM), Extended Data Output RAM (EDO RAM), Extended Data Output DRAM (EDO DRAM), Burst Extended Data Output DRAM (BEDO DRAM), Enhanced DRAM (EDRAM), synchronous DRAM (SDRAM), JEDEC SRAM, PC100 SDRAM, Double Data Rate SDRAM (DDR SDRAM), Enhanced SDRAM (ESDRAM), SyncLink DRAM (SLDRAM), Direct Rambus DRAM (DRDRAM), or Ferroelectric RAM (FRAM). The memory may be based on any of the above described memory chips, or any other available memory chips capable of operating as described herein. In another of these embodiments, the onboard computer has a removable memory apparatus. In still another of these embodiments, the onboard computer may provide USB connections to handheld USB storage devices, such as the USB Flash Drive line of devices manufactured by Twintech Industry, Inc. of Los Alamitos, Calif.

In some embodiments, the visible image displayed can be changed by uploading a different message to the onboard computer memory through a communication interface and the invisible image displayed can be changed by uploading a different message to the onboard computer memory through a communication interface. In one of these embodiments, the communication interface is a serial port. In one of these embodiments, the communication interface is a parallel port. In another of these embodiments, the communication interface is an Ethernet port. In another of these embodiments, the communication interface is an infrared port. In some embodiments, the communication interface provides access via a connection including, but not limited to, standard telephone line connections, LAN, WAN or PAN links (e.g., 802.11, 802.15, T1, T3, 56 kb, X.25, SNA, DECNET), broadband connections (e.g., ISDN, Frame Relay, ATM, Gigabit Ethernet, Ethernet-over-SONET), wireless connections, or some combination of any or all of the above. Connections can be established using a variety of communication protocols (e.g., TCP/IP, IPX, SPX, NetBIOS, Ethernet, ARCNET, SONET, SDH, Fiber Distributed Data Interface (FDDI), RS232, IEEE 802.11, IEEE 802.11a, IEEE 802.11b, IEEE 802.11g, IEEE 802.15, IEEE 802.15.1, CDMA, GSM, WiMax and direct asynchronous connections). In other embodiments, the communication interface may be accessed via any type and/or form of network and may include any of the following: a point-to-point network, a broadcast network, a wide area network, a local area network, a telecommunications network, a data communication network, a computer network, an ATM (Asynchronous Transfer Mode) network, a SONET (Synchronous Optical Network) network, a SDH (Synchronous Digital Hierarchy) network, a wireless network and a wireline network. In some embodiments, the communication interface may comprise a wireless link, such as an infrared channel or satellite band. The communication interface may be accessed via a network having a bus, star, or ring network topology, or of any such network topology as known to those ordinarily skilled in the art capable of supporting the operations described herein. The network may comprise mobile telephone networks utilizing any protocol or protocols used to communicate among mobile devices, including AMPS, TDMA, CDMA, GSM, GPRS or UMTS. In some embodiments, different types of data may be transmitted via different protocols. In other embodiments, the same types of data may be transmitted via different protocols.

In some embodiments, the invisible image displayed can be changed by toggling switches, representing individual emitters. In other embodiments, the invisible image displayed can be changed by toggling switches, representing groups of emitters. In still other embodiments, the invisible image displayed can be changed by toggling jumpers, representing individual emitters. In other embodiments, the invisible image displayed can be changed by toggling jumpers, representing groups of emitters.

Figure 4A:
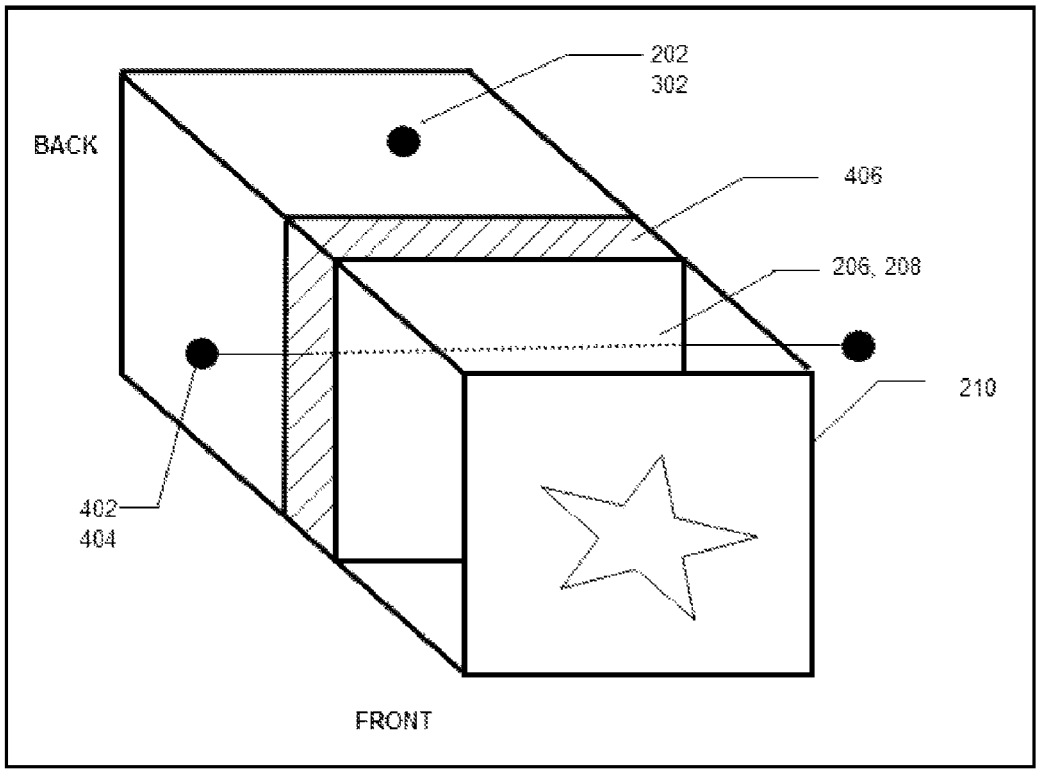
FIG. 4A is a block diagram depicting one embodiment of a wide-spectrum display where light shines through the side of an intermediary layer in the display.

Referring now to FIG. 4A, a block diagram depicts an embodiment of a wide-spectrum display where light is shone through the side of an intermediary layer 406 in the display. This process of illuminating a display from the side of an intermediary layer 406 may be referred to as edge lighting. The wide-spectrum display includes an invisible spectrum source 402, an intermediary surface 406 and a front surface 210. The front surface 210 contains a visible image. In some embodiments, the intermediary surface 406 is also the front surface 210. In other embodiments, the wide-spectrum display includes a diffuser 206. In still other embodiments, the wide-spectrum display includes a mask 208. In yet other embodiments, the wide-spectrum display includes both a diffuser 206 and a mask 208.

In one embodiment, light is emitted from multiple edges of the intermediary surface 406 of the display. In another embodiment, the intermediary layer includes a light enhancement system, which improves the efficiency of channeling the light emission towards the front of the display 210. In still another embodiment, the intermediary layer includes a light guiding system which improves the efficiency of channeling the light emission towards the front of the display 210.

In one embodiment, invisible light 402 is emitted from the edge of the display through the intermediary layer 406. In another embodiment, visible light 302 is emitted from the back of the display and invisible light 402 is emitted from the edge of the display through the intermediary layer 406. In still another embodiment, invisible light 202 is emitted from the back of the display and visible light 404 is emitted from the edge of the display through the intermediary layer 406. In yet another embodiment, visible light 402 and invisible light 404 are emitted from the edge of the display through the intermediary layer 406.

In one embodiment, the intermediary layer 406 has an image etched into it. In another embodiment, when the invisible light source 402 is shone through the intermediary layer 406, the etching provides the functionality of a mask 208, directing the invisible emission towards the audience only where the surface is etched. In still another embodiment, the intermediary layer 406 does not have an image etched into it. In still another embodiment, the intermediary layer 406 has a mask 208 which defines the shape of the invisible content. In still even another embodiment, the intermediary layer 406 has a light guide or light enhancement system, which channels the invisible spectrum towards the audience, where a mask 208 defines shape of the invisible content.

In one embodiment, the mask 208 allows invisible light through selected areas to sharpen the invisible image. In another embodiment, the mask 208 transmits most visible spectrum light. In still another embodiment, the mask 208 transmits all visible light.

In one embodiment, the mask 208 is opaque to both visible and invisible light and is placed before the intermediary surface 406 (further from the front 210). In another embodiment, the mask 208 is transparent in the visible spectrum and opaque in the invisible spectrum and is placed before the intermediary surface 406 (further from the front 210). In still another embodiment, the mask 208 is transparent in the visible spectrum and opaque in the invisible spectrum and is placed after the intermediary surface 406 (closer to the front 210).

In one embodiment, the visible light 302 is emitted from the back of the display and the invisible light 402 is emitted from the edge of the display through the intermediary layer 406 where it is shaped by the mask 208, giving the box the appearance of an evenly-illuminated, back-lit advertising light box to an audience who chooses not to view the display through a wavelength conversion device. In another embodiment, visible light 404 is emitted from the edge of the display and invisible light 202 is emitted from the back of the display through the intermediary layer 406 where it is shaped by the mask 208, giving the box the appearance of an evenly-illuminated, back-lit advertising light box to an audience who chooses not to view the display through a wavelength conversion device. In still another embodiment visible light 404 is emitted from the edge of the display and invisible light 402 is emitted from the edge of the display through the intermediary layer 406, where it is shaped by the mask 208, giving the box the appearance of an evenly-illuminated, back-lit advertising light box to an audience who chooses not to view the display through a wavelength conversion device.

In still another embodiment, visible light 404 is emitted from the edge of the display through the intermediary layer 406, and high resolution invisible light 202 where each array element (pixel) can be selectively turned on or off is emitted from the back of the display through the intermediary layer 406, with optional use of a mask 208, giving the box the appearance of an evenly-illuminated, back-lit advertising light box to an audience who chooses not to view the display through a wavelength conversion device.

In one embodiment, light shines from the side, or edge of the wide-spectrum display into an intermediary layer 406. In still another embodiment, the surface 406 is a light guide, efficiently directing light to the front of the display. In another embodiment, the intermediary layer 406 is a transparent surface having depth and made of a material such as glass or acrylic. In another embodiment, the intermediary layer 406 is a semi-transparent surface having depth and made of a material such as glass or acrylic. In another embodiment, light passes freely through the surface 406, providing little or no light to the front surface 210. In still another embodiment, the surface 406 has an image etched into it which reflects the light shone through the surface 406, directing the light towards the front surface 210. Consequently, by using a wavelength conversion device, a viewer facing the front surface 210 sees reflections from the etching contained in the surface 406 complementing and contributing to the visible image on the front surface 210, which together produce a wide-spectrum display. In some embodiments, the display is front-lit as discussed above in connection with FIG. 2.

Figure 4B:
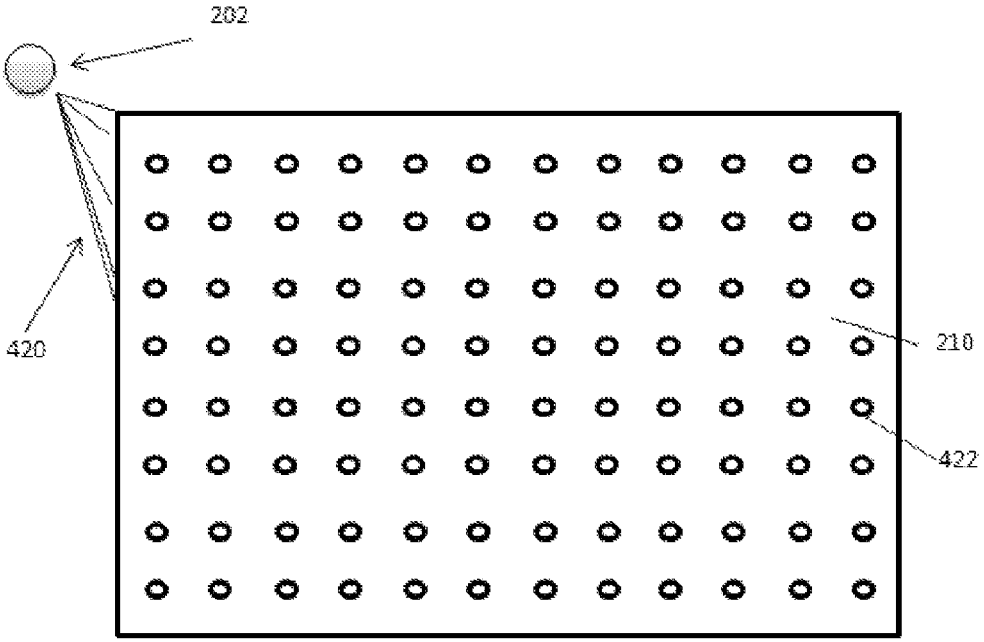
FIG. 4B is a block diagram depicting an embodiment of a wide-spectrum display including an emitter shining light through a light guide, which channels the light to at least one location in the display.

Referring now to FIG. 4B, a block diagram depicts an embodiment of a wide-spectrum display including an emitter shining light through a light guide 420, which channels the light to at least one location in the display. The system includes an invisible light source 202 and a light guide 420, which emerges in narrow holes 422 at the front of the display 210. In one embodiment, the invisible light source 202 is coupled to the light guide 420. In another embodiment, the invisible light source 202 is coupled to the light guide 420 using a lens. In still another embodiment, the front of the display 210 contains a visible image. In yet another embodiment, the front of the display 210 is made of one or a combination of poster substrate, plastic, paper, metalized paper, fabric, glass, corrugate, or some other substance.

In one embodiment, the light guide 420 is an optical waveguide that transmits light from the invisible light emitter 202 to the front of the display 210. In another embodiment, the light guide 420 is an optical fiber. In still another embodiment, the light guide 420 is made of glass. In still even another embodiment, the light guide 420 is made of plastic. In still another embodiment, the light guide 420 is composed of a single optical fiber. In yet another embodiment, the light guide 420 is composed of a plurality of optical fibers.

In one embodiment, the holes 422 in the front of the display 210 are high density perforations, defining potential terminal points of the light guide 420. In another embodiment, the holes 422 in the front of the display 210 define all possible pixels in the display. In another embodiment, the holes 422 in the front of the display 210 define the pixels that are illuminated in the display. In still another embodiment, the holes 422 in the front of the display 210 are plainly visible. In still even another embodiment, the holes 422 in the front of the display 210 are not plainly visible. In yet another embodiment, the holes 422 in the front of the display 210 only exist where invisible light is displayed.

In some embodiments, the light guide 420 is end-emitting. In one of these embodiments, the end-emitting light guide 420 terminates on the same plane as the surface of the display 210. In another of these embodiments, the end emitting light guide 420 terminates behind the surface of the display 210. In still another of these embodiments, the end-emitting light guide 420 terminates in front of the surface of the display 210. In other embodiments, the light guide 420 is side-emitting. In one of these embodiments, a side-emitting light guide 420 is woven through the holes in the front of the display 422.

In one embodiment, the emitter is a high-density, wide-spectrum display whose individual pixels are channeled through the light guide 420 to the front of the display 210, changing the spacing between pixels. In another embodiment, the channeling magnifies the space between pixels to grow the size of the display space. In this embodiment, a very small display can be magnified over a very large surface area without affecting the image resolution. In some embodiments, where the light source 202 is a high-density light display, such as a wide-spectrum display, or a high-density, invisible-spectrum display, the displayed image can be changed by changing the image produced at the light source.

Figure 4C:
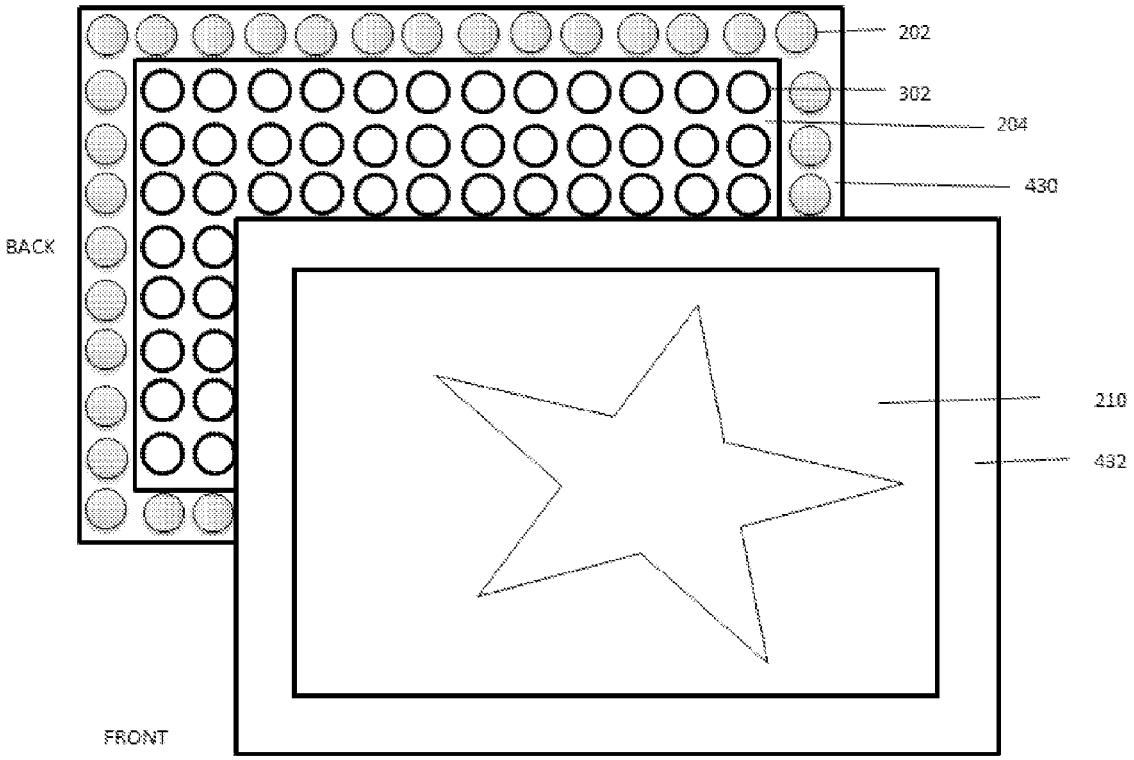
FIG. 4C is a block diagram depicting an embodiment of a wide-spectrum display with an outer frame.

Referring now to FIG. 4C, a block diagram depicts an embodiment of a wide-spectrum display with an outer frame. The system includes a back surface 204, the back of the outer frame 430, invisible light emitters 202, a front surface 210 and an outer frame front surface 432. In brief overview, the visible image displayed on a front surface 210 is surrounded by a non-structural outer frame containing invisible spectrum content. Taken together, the inner display and the outer frame form a wide-spectrum display. In some embodiments, attaching invisible spectrum outer frame edge(s) to conventional displays provides a new expression space for conventional displays, allowing wide-spectrum messages to be displayed. In other embodiments, attaching invisible spectrum outer frame edge(s) to conventional displays provides a new advertising space, and additional advertising real estate which can be a new revenue source for owners of exiting conventional displays.

In one embodiment, the inner display is illuminated using visible spectrum emitters 302. In another embodiment, the inner display is a wide-spectrum display, using both visible and invisible emitters. In still another embodiment, the inner display is not illuminated. In yet another embodiment, the inner display is a display in the invisible spectrum and the outer frame includes a display in the visible spectrum.

In one embodiment, the outer frame 430 consists of one edge. In another embodiment, the outer frame 430 consists of multiple edges. In still another embodiment, multiple frame edges attach to each other. In yet another embodiment, outer frame edge(s) contain a mounting apparatus that attaches to a conventional display.

In one another embodiment, the front surface 432 of the outer frame 430 is made of material that is opaque in the visible spectrum, appearing as a decorative display frame. In another embodiment, the front surface 432 of the outer frame 430 is made of material that is not opaque in the visible spectrum. In still another embodiment, the front surface 432 of the outer frame 430 is transparent in the invisible spectrum. In still even another embodiment, the front surface 432 of the outer frame 430 is semi-transparent in the invisible spectrum. In still another embodiment, the front surface 432 of the outer frame 430 displays a visible image.

In one embodiment, the outer frame contains visible and invisible spectrum emitters, as described above in connection with FIG. 2A-2B. In another embodiment, the outer frame emitters are invisible and visible spectrum emitters, as described above in connection with FIG. 3A. In still another embodiment, the outer frame emitters are wide-spectrum pixels as discussed above in connection with FIG. 3B. In still even another embodiment, the outer frame emitters are edge lit, as discussed in conjunction with FIG. 4A.

In another embodiment, the invisible spectrum content in the outer frame 430 relates to the visible content in the inner display. In another embodiment, the invisible spectrum content in the outer frame 430 relates to the wide-spectrum content in the inner display. In still another embodiment, the invisible spectrum content in the outer frame 430 does not relate to the visible content in the inner display. In still even another embodiment, the invisible spectrum content in the outer frame 430 does not relate to the wide-spectrum content in the inner display. In still another embodiment, the invisible spectrum content in the outer frame 430 does not relate to the visible spectrum content in the outer frame. In yet another embodiment, the invisible spectrum content in the outer frame 430 relates to the visible spectrum content in the outer frame 430.

In one embodiment, power for the outer display is obtained via a power outlet that is separate from the inner display's power outlet. In another embodiment, power for the outer display(s) is obtained via the inner display's internal power outlet. In still another embodiment, power for the outer display(s) is obtained via splicing into the inner display's power source. In still even another embodiment, power for the outer display is obtained via a solar panel or array of solar panels.

In one embodiment, the outer display(s) is individually attached to the inner display using an adhesive, such as glue, or tape. In another embodiment, the outer display(s) is attached to the inner display using hardware including but not limited to screws, nuts and bolts, rivets, nails and staples, hook and loop fasteners, Velcro, tabs, slots, studs, rails, receptacles, magnets, and other fastening devices. In still another embodiment, the outer display(s) is attached to the inner display by welding. In yet another embodiment, an outer display is attached to one or more other outer display(s) using one or more method(s) described above.

Figure 4D:
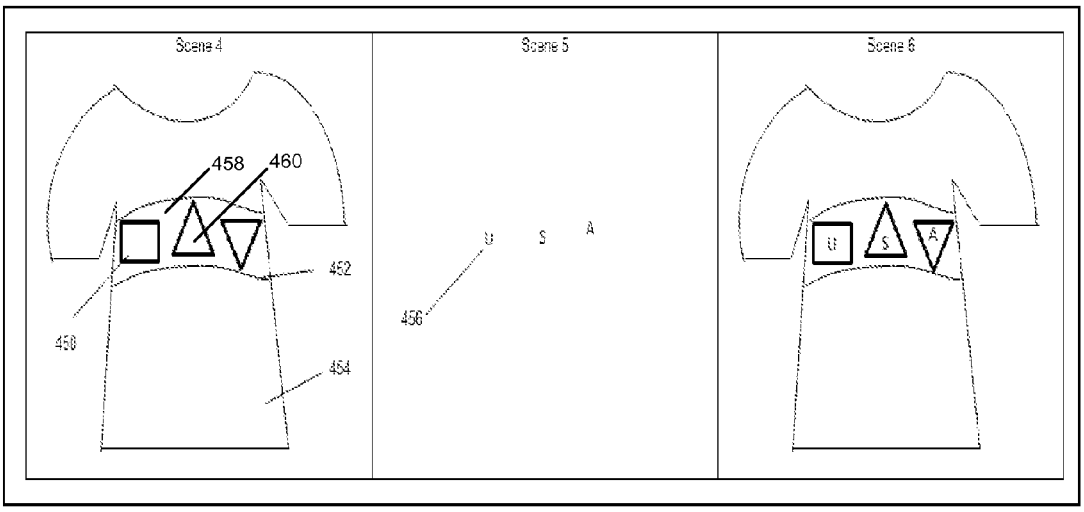
FIG. 4D is a block diagram depicting an embodiment of a system for displaying a message in a wearable material.

Referring now to FIG. 4D, a block diagram depicts an embodiment of a system for displaying a message in a wearable material. The system includes wearable material 454, a power supply 458, and an invisible-spectrum light emitter 456. In brief overview, FIG. 4D shows, at "Scene 4", wearable material 454 displaying a visible element including a first portion of a message. The invisible-spectrum light emitter 456 is coupled to the wearable material 454 and displays a second portion of the message. The power supply 458 is coupled to the wearable material 454. In some embodiments, the power supply 458 is coupled to the invisible-spectrum light emitter 456. In other embodiments, the system includes a plurality of power supplies 458. In still other embodiments, the system includes a clothing module 450 and a power distribution system 452. In one of these embodiments, the visible element 460 is displayed by a clothing module 450. In another of these embodiments, the clothing module 450 contains the invisible-spectrum light emitter 456.

Referring now to FIG. 4D, and in greater detail, in some embodiments, the visible element 460 is complemented by invisible content displayed by the invisible-spectrum light emitter 456. As shown in "Scene 6" of FIG. 4D, and in one embodiment, a wide-spectrum display on wearable material is formed by a synthesis of the visible element 460 (shown in "Scene 4" of FIG. 4D) and the invisible element displayed by the invisible-spectrum light emitter 456 (as shown in "Scene 5" of FIG. 4D) when viewed by a user of a wavelength conversion device (the synthesis shown in "Scene 6" of FIG. 4D).

In some embodiments, the wearable material 454 is an article of clothing, such as a shirt, pants, dress, skirt, blouse, socks, sweater, jacket, shoes, athletic shoes, boots or another article of clothing. In other embodiments, the wearable material 454 is an accessory, such as a bracelet, watch, jewelry, bag, gym bag, head band, cap, hat, wallet, case, carrying case, laptop case, brief case, luggage, sporting equipment or another accessory. In still other embodiments, the wearable material 454 includes a fastening device. In another of these embodiments, the invisible-spectrum light emitter 456 is fastened to the wearable material 454 by the fastening device. In still another of these embodiments, the clothing module 450 containing at least one of the invisible-spectrum light emitter 456 and the visible element 460 is fastened to the wearable material 454 by the fastening device.

In one embodiment, the power supply 458 is located in an unobtrusive pouch in the wearable material 454. In another embodiment, the power supply 458 is woven into an unobtrusive pouch in the wearable material 454. In another embodiment, the power supply 458 includes a fastening device. In still another embodiment, the power supply 458 is integrated into the wearable material 454. In another embodiment, the power supply 458 is coupled to an article of clothing 454. In still even another embodiment, the power supply 458 is coupled to an accessory 454. In yet another embodiment, the power supply 458 is detachable from the wearable material 454. In some embodiments, the wearable material 454 includes design elements useful for affixing clothing modules 450, power supplies 458, or invisible-spectrum light emitters 456 to the wearable material 454. In one of these embodiments, the wearable material 454 includes elements such as clips, magnets, adhesives, interlocking connectors, buttons, hook and loop fasteners, Velcro, and other fastening devices. In other embodiments, the invisible-spectrum light emitters 456 include a fastening device.

In one embodiment, the power supply 458 is a battery. In another embodiment, the power supply 458 is a battery removable from the wearable material 454. In another embodiment, the power supply 458 is a primary cell battery. In still another embodiment, the power supply 458 is a rechargeable (secondary cell) battery. In yet another embodiment, the power supply 458 is a rechargeable battery employing secondary cell chemistry such as lead and sulfuric acid, nickel cadmium (NiCd), nickel metal hydride (NiMH), lithium ion (Li-ion), lithium ion polymer and other cell chemistries. In further embodiments, the power supply 458 is a small battery typically associated with a different use, including, but not limited to powering cellular phones, cordless phones, phones, watches, Personal Data Assistants (PDAs) and music players.

In one embodiment, a power supply 458 is recharged using kinetic energy. Kinetic energy may be generated by harvesting energy expended by the wearer using methods including, but not limited to the piezoelectric effect, pendulous motion, rotary motion, linear motion, winding a coil, compressing a spring. In another embodiment, these methods for harvesting energy are used with wearable material 454 is an item typically associated with movement, such as shoes and wristbands. In still another embodiment, a power-harvesting apparatus includes, but is not limited to braces for joints such as the knees, elbows, jaw, hips, ankles, shoulders, wrists, knuckles fingers, neck, and the back. In still even another embodiment the power supply 458 is recharged using wireless receivers that harvest power from the electromagnetic spectrum including, but not limited to Radio Frequency (RF) receivers, rectifying antenna, photovoltaic cells, inductors, resonant inductors and other receivers.

In one embodiment, the invisible-spectrum light emitters 456 include a high-resolution emission apparatus. In another embodiment, the invisible-spectrum light emitters 456 include an edge-lighting source as described above. In still another embodiment, the invisible-spectrum light emitters 456 include at least one electrical connector coupling the invisible-spectrum light emitter to the power source 458. In yet another embodiment, the invisible-spectrum light emitters 456 display content 456 in the invisible spectrum. In some embodiments, an invisible-spectrum light emitter 456 is an emitter such as an LED, an OLED, an electroluminescent emitter, ink, or another device or system that emits light in the invisible spectrum. In other embodiments, the invisible-spectrum light emitters 456 are embedded in the clothing module 450.

In one embodiment, the invisible-spectrum light emitters 456 displays an invisible-spectrum message in the clothing modules 450 using an edge lit source 402 and an intermediary surface 406 as described above in FIG. 4A. In another embodiment, an edge lit source 402 and an intermediary surface 406 and optionally a mask 208 and optionally a diffuser 206 as described above in FIG. 4A create the invisible spectrum message in the clothing modules 450. In some embodiments, the invisible-spectrum message is an invisible element 104 as described above.

In one embodiment, a high resolution emission apparatus creates the invisible-spectrum message. In another embodiment, a high resolution emission apparatus mounted on a rigid substrate, such as a circuit board, creates the invisible-spectrum message. In still another embodiment, a high resolution emission apparatus mounted on a flexible substrate, such as a circuit board creates the invisible-spectrum message. In still even another embodiment, an invisible spectrum emission apparatus and a light guide system, as described above in FIG. 4B, create the invisible spectrum message. In some embodiments, the invisible spectrum message can be changed. In other embodiments, the invisible spectrum message cannot be changed.

In one embodiment, the invisible spectrum message is user-definable. In another embodiment, the invisible spectrum message can be changed manually. In still another embodiment, the invisible spectrum message can be changed manually by toggling switches, representing individual emitters. In still even another embodiment, the invisible image displayed can be changed by toggling switches, representing groups of emitters forming symbols including, but not limited to letters, and glyphs. In yet another embodiment, the invisible spectrum message can be changed remotely, wirelessly, or by physically changing a memory chip containing the invisible content, as discussed above.

In some embodiments, a clothing module 450 couples the invisible-spectrum light emitter 456 and the power supply 458 to the wearable material 454. In other embodiments, the clothing module 450 is a container attached to the wearable material 454 and containing the invisible-spectrum light emitter 456 and the power supply 458. In still other embodiments, the clothing module 450 is a pocket attached to the wearable material 454 and containing the invisible-spectrum light emitter 456 and the power supply 458.

In one embodiment, a clothing module 450 attaches to the wearable material 454. In another embodiment the clothing module 450 attaches to the wearable material 454 using clips, magnets, adhesives, interlocking connectors, buttons, hook and loop fasteners, Velcro, and other fastening devices. In still another embodiment, the number of clothing modules 450 that can be attached to the wearable material 454 is bounded by the surface area of the wearable material 454. In yet another embodiment, the clothing module 450 is affixed to the outside of the wearable material 454.

In one embodiment, the clothing module 450 is woven into the wearable material 454. In another embodiment, the clothing module 450 is affixed to the inside of the wearable material 454. In still another embodiment, the clothing module 450 attaches to the power supply 458. In yet another embodiment the wearable clothing module 450 is attached to the power supply 458 using clips, magnets, adhesives, interlocking connectors, buttons, hook and loop fasteners, Velcro, zippers and other fastening devices.

In one embodiment, the clothing module 450 is suspended to an object behind the wearable material 454 by means of a secondary attachment device. In another embodiment, the secondary attachment device includes, but is not limited to, a necklace, a band or another attachment device.

In some embodiments, the clothing module 450 is an active module. In one of these embodiments, the clothing module 450 includes a power supply. In other embodiments, the clothing module 450 is a passive module. In one of these embodiments, the clothing module 450 does not have its own power source. In another of these embodiments, the clothing module 450 receives power from a power supply coupled to the wearable material via a power distribution system 452. In still another of these embodiments the number of passive clothing modules 450 that can be driven by the wearable material 454 is bounded by the wearable power supply 458 in the wearable material 454. In still even another of these embodiments, the passive clothing module 450 attaches to the wearable material 454 via an electrical connector to the power supply contained within the wearable material 454. In yet another of these embodiments, the electrical connector is a visible part of the design of the wearable material 454. In further embodiments, the electrical connector is visibly hidden in the wearable material 454.

In some embodiments, multiple electrical connectors in the wearable material 454 connect the clothing modules 450 to the wearable material 454. In other embodiments, multiple electrical connectors in the wearable material 454 are wired in parallel to one or more clothing modules 450. In still other embodiments, the electrical connectors in the wearable material 454 are wired in series to one or more clothing modules 450. In yet other embodiments, the clothing modules 450 are designed to connect to other clothing modules in series. In further embodiments, the clothing modules 450 are designed to connect to the wearable material 454 in parallel.

In one embodiment, electrical connectors may be disconnected from a clothing module 450. In another embodiment, electrical connectors may be disconnected from a power supply 458. In still another embodiment, the electrical connector is also the fastener(s) that couples the clothing module to the wearable material 454. In still even another embodiment, the electrical connectors are incorporated into the fastener(s).

In some embodiments, a digital system resides between the power supply 458 and the electrical connector(s). In other embodiments, a digital system resides between the electrical connector and the clothing module 450. In other embodiments, an analog system resides between the power supply 458 and the electrical connector(s). In still other embodiments, an analog system resides between the electrical connector and the clothing module 450.

In some embodiments, a digital, analog, or other logical system existing between the electrical connectors and the power supply 458 or the clothing module 450 is referred to as "logic." In other embodiment, the logic receives input from a sensor. In still other embodiments, the logic receives input from one or more sensors. In still even other embodiments, the sensors may be, but are not limited to, devices that sense, temperature, proximity, light, radio frequency, magnetic field, electrical resistance, pressure, sound, electrical charge, motion, orientation, humidity and speed. In further embodiments information obtained by the sensor(s) is displayed in the invisible message. In one of these embodiments, the invisible message graphically represents sensed data. In another of these embodiments, the invisible message symbolically represents sensed data. In still another of these embodiments, the sensor reading is displayed in the invisible message. In still another of these embodiments, the invisible message displays the current temperature. In yet another embodiment the invisible message displays a speed at which the wearer moves.

In one embodiment, the clothing module 450 has a rectilinear shape. In another embodiment, the clothing module 450 has a multisided shape. In still another embodiment, the clothing module 450 has a curved shape. In still even another embodiment, the clothing module 450 is shaped to form a design. In still another embodiment, the clothing module 450 is covered in fabric, including but not limited to cotton, polyester, silk, Dacron, and other fabrics. In yet another embodiment, the fabric cover of the clothing module 450 contains an image displayed in the visible spectrum. In some embodiments, the apparel 454 and the clothing modules 450 are sold separately. In other embodiments, the apparel 454 and the clothing modules 450 are sold together.

Figure 5:
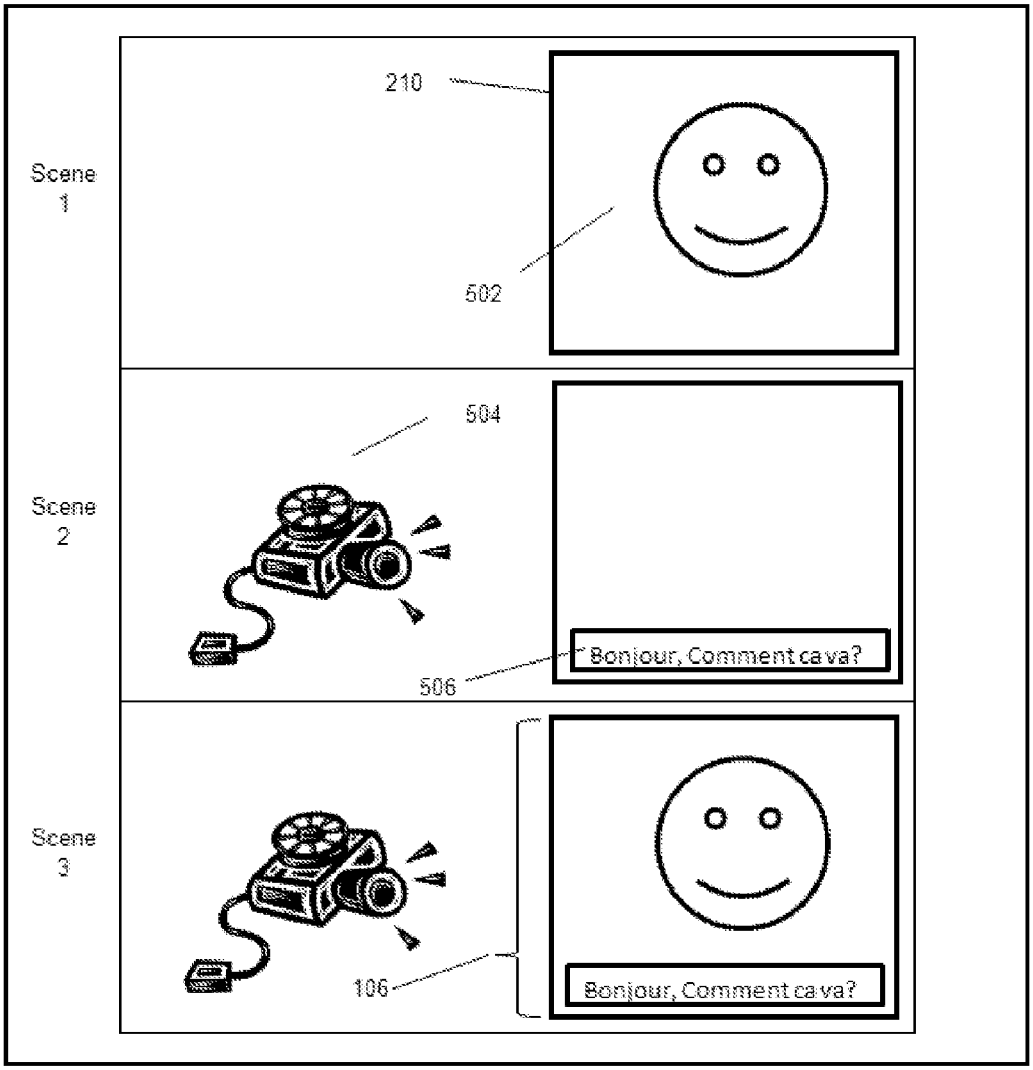
FIG. 5 is a block diagram depicting one embodiment of a system for projecting a wide-spectrum display.

Referring now to FIG. 5, a block diagram depicts an embodiment of a system for projecting a wide-spectrum display. The system includes a front surface 210, a visible image 502, an invisible spectrum projection source 504, an invisible spectrum image 506, and a wide-spectrum display 106. In brief overview, the visible image 502 is displayed on a front surface 210 in the visible light spectrum using a display device such as a television, or a front, rear, or side projector. In another embodiment, an invisible spectrum emitter 504 projects an invisible spectrum image 506 on the front surface 210. Rendered visible through a wavelength conversion device, the invisible spectrum image 506 provides content that contributes to the visible image 502, producing a wide-spectrum information display 106.

In one embodiment, the invisible spectrum projection source 504 is a laser. In another embodiment, the invisible spectrum projection source 504 is a focused Light-Emitting Diode (LED) beam. In still another embodiment, the invisible spectrum projection source 504 is a Digital Light Projector (DLP). In still even another embodiment, the invisible spectrum projection source 504 is any source that can project light in the invisible spectrum. In yet another embodiment, a plurality of invisible spectrum projection sources 504 is used. In some embodiments, the projection of the invisible element onto a physical surface is applied to produce subtitles for movie theaters, theatrical productions, public events or other spectator events or spaces where certain people who could benefit from text or translations that can be read to complement activity taking place in the visible and audio spectra. In other embodiments, however, the invisible element is not projected onto a physical surface; for example, similar to visible light produced by lasers during an indoor or outdoor laser light show, or to firecrackers or fireworks displayed outdoors, the invisible element can exist in free space and contribute to and compliment a visual scene when viewed through a wavelength conversion device without requiring projection.

In some embodiments, the invisible spectrum projection source 504 also includes functionality for projecting light in the visible spectrum. In other embodiments, the wide-spectrum display scales to very large sizes to accommodate a larger display surface; for example, a greater distance is placed between the invisible spectrum projection source 504 and the front surface 210 or a plurality of invisible spectrum projection sources 504 are employed to cover the display space.

In one embodiment, the display space could be any surface in the environment, including for example, the side of a large public building. In another embodiment, the display space provides a new expression space for applications such as advertising, advocacy and art, allowing messages to be communicated on surfaces that were previously restricted for aesthetic or historical preservation purposes; these displays may be considered to carry a non-marking graffiti that does not affect scenes experienced solely in the visible spectrum.

Figure 6A:
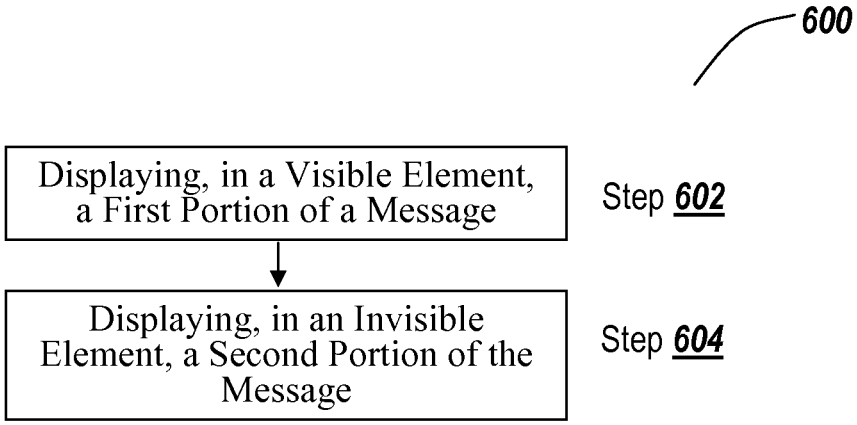
FIG. 6A is a flow diagram depicting one embodiment of the steps taken in a method for displaying a message in a wide-spectrum display.

Referring now to FIG. 6A, a flow diagram depicts one embodiment of the steps taken in a method 600 for displaying a message in a wide-spectrum display. In brief overview, the method includes the step of displaying, in a visible element, a first portion of a message (step 602). The method includes the step of displaying, in an invisible element, a second portion of the message (step 604).

Referring now to FIG. 6A, and in greater detail, a visible element displays a first portion of a message (step 602). In one embodiment, the visible element is projected onto a surface. In another embodiment, the visible element displays a first portion of an advertisement. In still another embodiment, the visible element displays a first portion of filmed content. In still even another embodiment, the visible element displays a first portion of live content. In yet another embodiment, the visible element displays a first portion of a game.

An invisible element displays a second portion of the message (step 604). In some embodiments, an invisible spectrum light emitter produces the invisible element. In one of these embodiments, an invisible spectrum source produces infrared light displaying the second portion of the message in the invisible element. In another of these embodiments, an invisible spectrum source produces ultraviolet light displaying the second portion of the message in the invisible element. In some embodiments, the invisible element is etched onto a transparent surface having depth. In some embodiments, the invisible element is etched onto a semi-transparent surface having depth. In one of these embodiments, a mask in a wide-spectrum display sharpens the second portion of the message displayed in the invisible element. In other embodiments, the invisible element is projected onto a physical surface. In other embodiments, the invisible element provides back lit illumination onto a physical surface. In other embodiments, the invisible element provides edge lit illumination onto a physical surface.

In one embodiment, the invisible element displays information associated with the visible element. In another embodiment, the invisible element forms, in combination with the visible element, an advertisement. In still another embodiment, the invisible element forms, in combination with the visible element, a portion of a game. In still even another embodiment, the invisible element displays a subtitle to content displayed in the visible element. In yet another embodiment, the invisible element displays content in the invisible spectrum enhancing the first portion of the message displayed by the visible element. In yet another embodiment, the message displayed in the visible element is a physical object. In yet another embodiment, the message displayed in the visible element is a scene. In yet another embodiment, the invisible element displays content in the invisible spectrum that is not directly associated with the visible element. In yet another embodiment, the visible element displays content that signifies that there is content in the invisible spectrum.

Figure 6B:
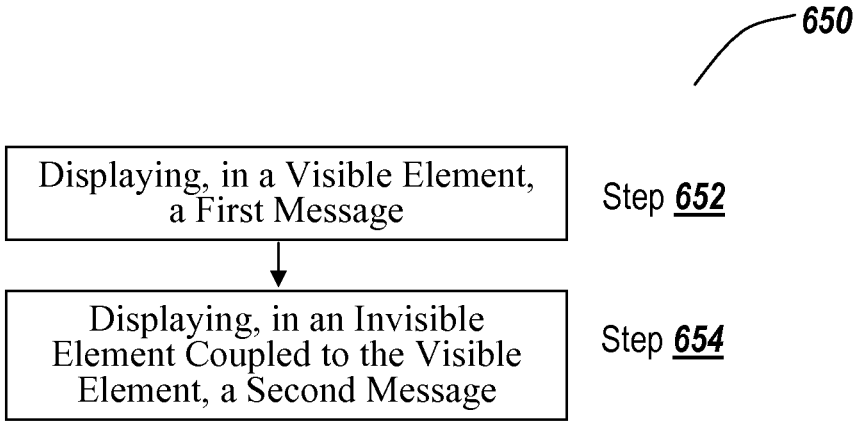
FIG. 6B is a flow diagram depicting an embodiment of the steps taken in a method for displaying a plurality of messages in a wide-spectrum display.

Referring now to FIG. 6B, a flow diagram depicts an embodiment of the steps taken in a method 650 for displaying messages in a wide-spectrum display. The method includes the step of displaying, in a visible element, a first message (step 652). The method includes the step of displaying, in an invisible element coupled to the visible element, a second message (step 654).

Referring to FIG. 6B, and in greater detail, a visible element displays a first message (step 652) and an invisible element displays a second message. In some embodiments, the visible element 102 displays the first message as described above in connection with FIG. 6A and the step of displaying a first portion of a message and the invisible element 104 displays the second message as described above in connection with FIG. 6A and the step of displaying a second portion of the message; however, the messages displayed by the visible element and the invisible element need not be portions of a single message or even related messages. In another of these embodiments, the visible element 102 may display an image, a projected image, at least a portion of a filmed work, at least a portion of a game, an advertisement or other content as described above, and the invisible element 104 may display a second image, at least a portion of a second filmed work, at least a portion of a second game, a second advertisement, or other content. In still another of these embodiments, the visible element 102 is a physical object. In still even another of these embodiments, an invisible-spectrum light source coupled to the visible element 102 displays the invisible element 104. In yet another of these embodiments, and as discussed in greater detail above in connection with FIG. 4C, the wide-spectrum display includes an outer frame coupling the invisible element to the visible element.

Having described certain embodiments of methods and systems for displaying messages in a wide-spectrum display, it will now become apparent to one of skill in the art that other embodiments incorporating the concepts of the disclosure may be used. Therefore, the disclosure should not be limited to certain embodiments, but rather should be limited only by the spirit and scope of the following claims.

The invention claimed is:

1. A wide-spectrum display comprising:

a first graphical image, provided by a first source producing visible spectrum emissions, comprising a first portion of content, the first graphical image rendered on the display in a manner visible to the unaided human eye; and a second graphical image, provided by a second source producing invisible spectrum emissions, comprising a second portion of content, the second graphical image rendered on the display in a manner invisible to the unaided human eye, wherein:

the first graphical image and the second graphical image are superimposed on the display, the content, including at least the first and second graphical images, is viewable via a wavelength conversion device, and the first and second graphical images are complementary.

2. The wide-spectrum display of claim 1, wherein the second source is an invisible spectrum source producing infrared spectrum emissions.

3. The wide-spectrum display of claim 1, wherein the second source is an invisible spectrum source producing ultraviolet spectrum emissions.

4. The wide-spectrum display of claim 1, further comprising an etching in a semi-transparent surface of the display, wherein the etching defines the shape of the second graphical image.

5. The wide-spectrum display of claim 1, further comprising:

a mask that sharpens and defines the shape of the second graphical image invisible element.

6. The wide-spectrum display of claim 1, wherein the first graphical image is provided on a wearable material;

the second light sources is an invisible-spectrum light emitter coupled to the wearable material; and a power supply is coupled to the wearable material and the invisible-spectrum light emitter.

7. The wide-spectrum display of claim 1, wherein the content is at least one member selected from the group consisting of: filmed content, live content, dynamic content, and static content.

8. The wide-spectrum display of claim 1, further comprising at least one pixel producing at least the invisible spectrum emissions, wherein the at least one pixel includes an invisible spectrum source producing at least one of infrared or ultraviolet light.

9. The wide-spectrum display of claim 8, wherein the at least one pixel produces wide-spectrum emissions and further comprises:

a first sub-pixel providing the invisible spectrum source producing at least one of infrared or ultraviolet light, a second sub-pixel providing red spectrum emissions;

a third sub-pixel providing green spectrum emissions; and a forth sub-pixel providing blue spectrum emissions, wherein a brightness of each sub-pixel is configured to be adjusted to produce different wavelength emissions.

10. The wide-spectrum display of claim 1, wherein the wide-spectrum display is a projection display.

11. The wide-spectrum display of claim 1, wherein the second source is invisible ink.

12. A method for displaying a message in a wide-spectrum display, the method comprising:

providing, by a first source producing visible spectrum emissions, a first graphical image comprising a first portion of content, the first graphical image rendered on the display in a manner visible to the unaided human eye; and providing, by a second source producing invisible spectrum emissions, a second graphical image comprising a second portion of content, the second graphical image rendered on the display in a manner invisible to the unaided human eye, wherein:

the first graphical image and the second graphical image are superimposed on the display, the content, including at least the first and second graphical images, is viewable via a wavelength conversion device, and the first and second graphical images are complementary.

13. The method of claim 12, wherein the second source is an invisible spectrum source producing infrared light.

14. The method of claim 12, wherein the second source is by an invisible spectrum source producing ultraviolet light.

15. The method of claim 12, wherein:

the first graphical image is provided on a wearable material; and the second light source is provided by an invisible-spectrum light emitter coupled to the wearable material.

16. The method of claim 12, wherein the content is at least one member selected from the group consisting of: filmed content, live content, dynamic content, and static content.

17. The method of claim 12, further comprising at least one pixel producing at least the invisible spectrum emissions, wherein the at least one pixel includes an invisible spectrum source producing at least one of infrared or ultraviolet light.

18. The method of claim 17, wherein the at least one pixel produces wide-spectrum emissions and further comprises:

a first sub-pixel providing the invisible spectrum source producing at least one of infrared or ultraviolet light, a second sub-pixel providing red spectrum emissions;

a third sub-pixel providing green spectrum emissions; and a forth sub-pixel providing blue spectrum emissions, wherein a brightness of each sub-pixel is configured to be adjusted to produce different wavelength emissions.

19. The method of claim 12, wherein the wide-spectrum display is a projection display.

20. The method of claim 12, wherein the second source is invisible ink.

* * * * *

UNITED STATES PATENT AND TRADEMARK OFFICE

CERTIFICATE OF CORRECTION

PATENT NO. : 8,531,308 B2
APPLICATION NO. : 12/863959
DATED : September 10, 2013
INVENTOR(S) : Dickie et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 332 days.

Signed and Sealed this
Fifteenth Day of September, 2015

Michelle K. Lee

Michelle K. Lee
*Director of the United States Patent and Trademark Office*